US005159916A

United States Patent [19]

Isogawa

[11] Patent Number: 5,159,916

[45] Date of Patent: Nov. 3, 1992

[54] IGNITION TIMING CONTROL MEMBER SUPPORTING STRUCTURE OF OUTBOARD MOTOR

[75] Inventor: Atsushi Isogawa, Hamamatsu, Japan

[73] Assignee: Sanshin Kogyo Kabushiki Kaisha, Hamamatsu, Japan

[21] Appl. No.: 725,548

[22] Filed: Jul. 3, 1991

[30] Foreign Application Priority Data

Jul. 9, 1990 [JP] Japan ..... 2-181056

[51] Int. Cl.[5] ..... F02P 5/02

[52] U.S. Cl. ..... 123/602; 123/149 C; 123/413

[58] Field of Search ..... 123/149 C, 149 D, 413, 123/599, 602

[56] References Cited

U.S. PATENT DOCUMENTS 3,955,550 5/1976 Carlsson ..... 123/599 X
4,114,583 9/1978 Sleder et al. ..... 123/602
4,606,314 8/1986 Yamazaki ..... 123/413

*Primary Examiner*—Tony M. Argenbright
*Attorney, Agent, or Firm*—Ernest A. Beutler

[57] ABSTRACT

An outboard motor having an improved timing plate mounting arrangement for its ignition system. The mounting plate has a hub portion that is journaled on the outer side of a cylindrical extension of the crankshaft wall and is held in place by a retainer plate that is bolted to the end surface of the wall and radially inwardly of the hub portion. The ignition plate carries a pulser coil that extends on the outer periphery of the flywheel of the engine and charging coils are mounted internally of the flywheel on the retainer plate.

16 Claims, 3 Drawing Sheets

IGNITION TIMING CONTROL MEMBER SUPPORTING STRUCTURE OF OUTBOARD MOTOR

BACKGROUND OF THE INVENTION

This invention relates to an ignition timing control member supporting structure for an outboard motor and more particularly to an improved arrangement for mounting the pulser coil of an outboard motor for rotation relative to the crankcase and adjacent the crankshaft of the engine.

It is well known in connection with certain types of engines to provide a flywheel magneto in which the flywheel carries a plurality of rotating magnets and which cooperates with a charging coil and a pulser coil for charging and firing an ignition circuit. In accordance with such arrangements, it is frequently the practice to mount the pulser coil on a plate that is rotatably journaled relative to the engine so as to adjust the timing in response to variations in other engine parameters, such as throttle valve setting.

In conjunction with outboard motors and other applications wherein the engine has its output shaft rotating about a vertically extending axis, it is normally the practice to mount the pulser coil on a plate that is journaled upon a cylindrical projection of a wall of the crankcase adjacent the flywheel. This mounting plate is then held in position by means of a retaining plate which is, in turn, held in position by bolts that are threaded into the crankcase radially outwardly of the cylindrical projection.

A disadvantage with this type of arrangement is that the bearing arrangement for the mounting plate requires play between the periphery of the cylindrical projection on which the plate is retained and the adjacent surfaces of the plate. As a result, inaccuracies in timing can result. This is particularly true in connection with outboard motors wherein the trim of the outboard motor can be changed and changes in trim angle can change the location of the mounting plate relative to the crankcase as the crankcase is tilted from an upright position to an inclined position.

Also, it is normally the practice to mount the charging coils on the same retaining plate that holds the timing plate in position. In order to access the fasteners that hold the retaining plate in position, the coils must be mounted at an elevated position and this also gives rise to an increase in length of the engine.

The difficulties with the prior art constructions can be best understood by reference to FIGS. 1 and 2. FIG. 1 is a side elevational view of a portion of the power head of an outboard motor that may be considered to have a conventional structure, although it does show a mounting plate in accordance with an embodiment of the invention. However, this figure shows the environment in conjunction with conventional mounting plates.

FIG. 2 is an enlarged cross sectional view taken through the upper portion of the crankshaft and shows the mounting for the ignition timing plate.

Referring first to FIG. 1, a two cycle, two cylinder inline crankcase compression internal combustion engine is identified generally by the reference numeral 11 and forms a portion of a power head of an outboard motor, which is shown only partially and is depicted as being attached to a transom 12 of a watercraft in a known manner. The mounting for the outboard motor permits steering movement about a generally vertically extending axis and tilt and trim movement about a generally horizontally disposed tilt axis, indicated by the pivot pin 13.

Although the invention is described in conjunction with a two cylinder inline crankcase compression two cycle engine, it should be readily apparent to those skilled in the art that the invention can be practiced with other types of engines. Also, even though the invention is described in conjunction with an outboard motor the invention can by utilized with other applications for internal combustion engines. However, the invention has particular utility in outboard motors or in other applications for internal combustion engines wherein the engine is supported with its output shaft rotatable about a vertically extending axis.

The engine 11 is comprised of a cylinder block 14 in which cylinder bores are formed. A cylinder head 15 is affixed to the cylinder block 14 in a suitable manner and mounts spark plugs 16 for firing the charge in the combustion chamber of the engine. The aforedescribed pistons, which are not shown, are connected to drive and crankshaft 17 which, as has been noted, is rotatably journaled about a vertically extending axis. The crankshaft 1 is journaled primarily by a crankcase member 18 that is affixed to the lower end of the cylinder block 14.

A charge is admitted to the crankcase chambers of the engine from an induction system that includes an air inlet device 19 that is contained within the protective cowling of the power head of the outboard motor, which is shown in phantom and is identified generally by the reference numeral 21. The air charge is delivered to a pair of horizontally disposed carburetors 22 in which throttle valves (one of which is shown in phantom at 23) are supported for controlling the speed of the engine. The carburetors 22 deliver a fuel/air charge to the crankcase chambers of the engine through an intake manifold, indicated generally by the reference numeral 24.

Referring now primarily to FIG. 2, it will be noted that the upper end of the crankcase 18 mounts an anti-friction bearing 25 which partially journals the crankshaft 17. The crankshaft 17 has a portion that extends through an upper wall of the crankcase 18 which is defined by a cylindrical boss 26. A flywheel 27 is affixed to the upper end of the crankshaft 17 by means of a key 28 and nut 29.

The flywheel 27 forms a portion of a flywheel magneto ignition system and to this end carries permanent magnets 29 which are arcuate in shape. The boss 26 has journaled upon its outer surface a timing plate 31 that carries a pulser coil 32. The timing plate 31 is connected in a manner which will be described in connection with FIG. 1, to a timing lever for rotating the plate 31 and a pulser coil, not shown, carried by the plate 31 which cooperates with the magnets 29 so as to trigger the ignition circuit.

The plate 31 is held in position by a retaining plate 32 which is affixed to the upper surface of the crankshaft 18 and specifically to a boss 33 thereof by means of a plurality of threaded fasteners 34. Charging coils 35 are mounted also on the retaining plate 32 and must be extending above the surface thereof by extension members 36 so as to afford access to the threaded fasteners 34. As should be readily apparent, the clearance between the outer surface of the boss 26 and the timing plate 31 can cause shifting of the timing plate 31 relative to the boss 26 when the outboard motor is tilted and this can adversely effect the timing. Also, as has been noted, the elevated mounting of the charging coils 35 causes the flywheel 27 to be spaced a substantial distance upward from the crankcase 18 and thus adds to the height of the engine.

It is, therefore, a principal object of this invention to provide an improved mounting arrangement for the timing plate of a magneto ignition system of an internal combustion engine that will insure accuracy in the timing regardless of changes in the angle of the output shaft.

It is a further object to this invention to provide a simplified and easily accessed mounting arrangement for the timing plate of an ignition system for an internal combustion engine.

It is a further object to this invention to provide a compact mounting arrangement for the timing plate of a magneto ignition system that will permit lower engine heights.

SUMMARY OF THE INVENTION

This invention is adapted to be embodied in an ignition arrangement for an internal combustion engine having an output shaft supported for rotation about an axis. An engine housing at least partially encloses the cutput shaft and has generally cylindrical wall section extending from one face thereof. The output shaft has an end portion extending through the one face of the engine housing and surrounded by the wall. An ignition plate has a hub portion rotatably journaled on the outer surface of the cylindrical wall and a retainer plate is affixed to the end surface of the cylindrical wall inwardly of the outer surface for retaining the ignition plate to the engine. A flywheel is affixed for rotation with the output shaft and at least one ignition coil is affixed to the ignition plate and cooperates with the flywheel.

DETAILED DESCRIPTION OF THE PREFERRED EMBODIMENT OF THE INVENTION

Figure 1:
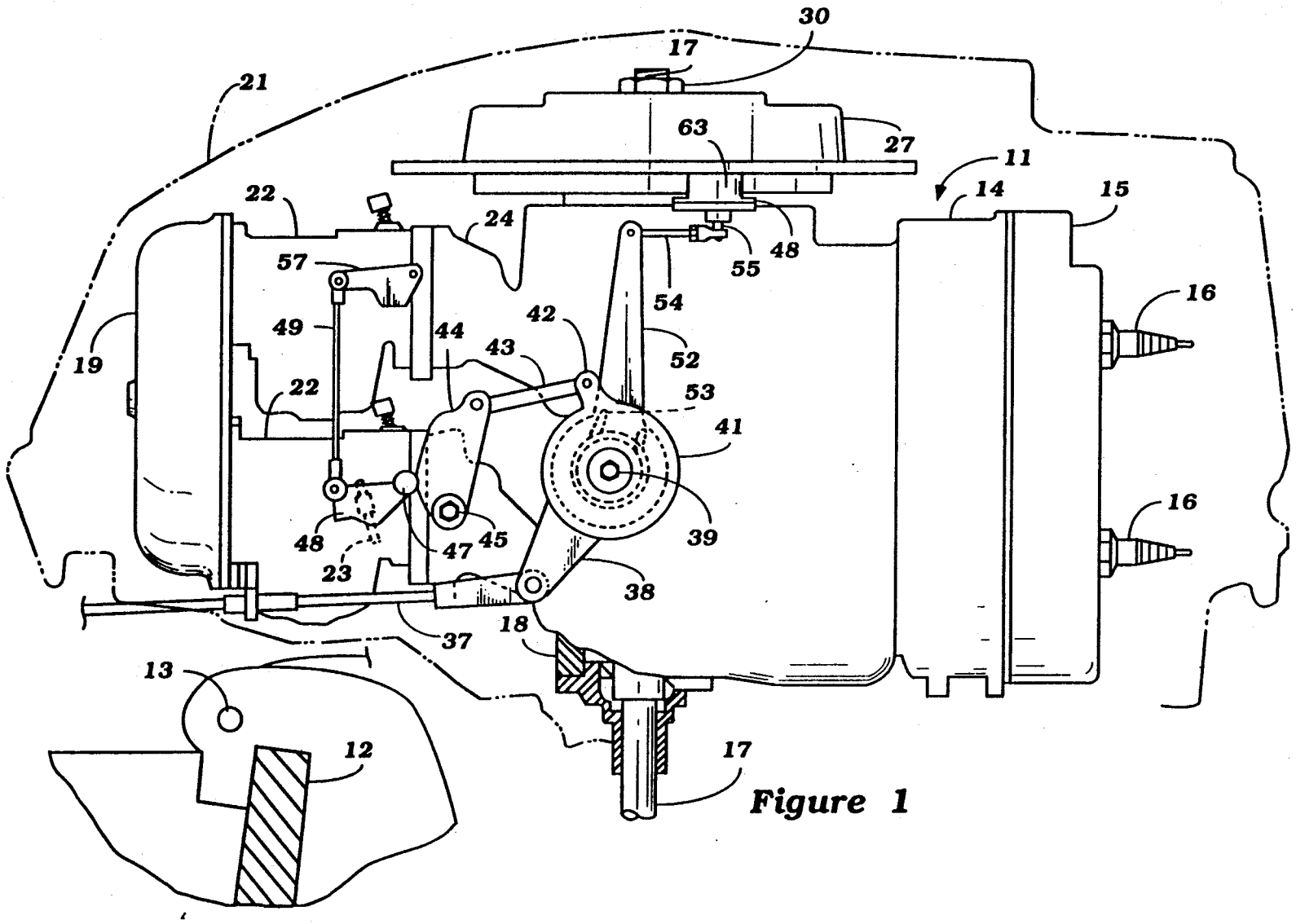
FIG. 1 is a side elevational view of a portion of an outboard motor having an ignition system constructed in accordance with an embodiment of the invention.

FIG. 1 has already been referred to for the general orientation of an outboard motor having either a conventional ignition mounting arrangement or a mounting arrangement constructed in accordance with an embodiment of the invention. As has been previously noted, the timing plate 31 is rotatably supported and is rotated in response to an engine condition, particularly the position of the throttle valves 23 so as to adjust the ignition timing in relation to engine speed. The construction for accomplishing this will now be described.

A remotely operated throttle control wire 37 extends from the engine 11 forwardly to a remotely positioned (not shown) throttle control. The control wire 37 is affixed to a throttle lever 38 which, in turn, is pivotally mounted on the crankcase 18 by means of a pivot bolt 39. This lever 38 is connected to a throttle drum 41 which is has a lever arm 42 that is pivotally connected to one end of a link 43. The opposite end of the link 43 is pivotally connected to a throttle control lever 44 that is pivotally mounted on the manifold 24 by a mounting bolt 45. The throttle control lever 44 has a cam surface 46 that is engaged with a follower 47 affixed to a throttle lever 48 that is connected to the shaft of one of the carburetor throttle valves 23. A link 49 is pivotally connected to the lever 48 and to a corresponding lever 51 of the other carburetor 22 so that the throttle valves 23 of the two carburetors 22 will be opened and closed in unison.

A spark control lever 52 is also pivotally supported on the pivot bolt 39 and has a spring biased lost motion connection to the drum 41. The spring is shown in broken lines and is identified generally by the reference numeral 53. The lost motion connection permits some movement of the throttle valves 23 before the spark control lever 52 begins to rotate and then permits the spark control lever 52 to rotate to a fully advanced position and then stop while permitting continued opening of the throttle valves 23. This type of construction is well known in the prior art and, for that reason, further description of it is believed to be unnecessary. The ignition control lever 52 is connected by means of a link 54 to a connector 55 of the ignition timing plate, which will now be described by reference to FIGS. 3 and 4.

Figure 3:
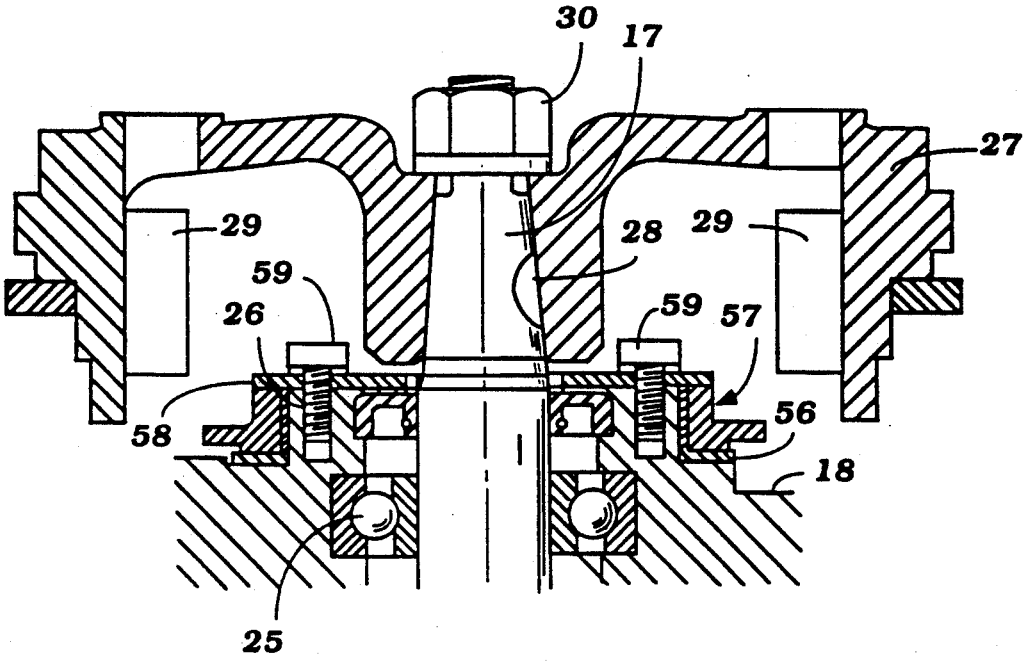
FIG. 3 is a cross sectional view, in part similar to FIG. 2, and shows an embodiment of the invention.
Figure 2:
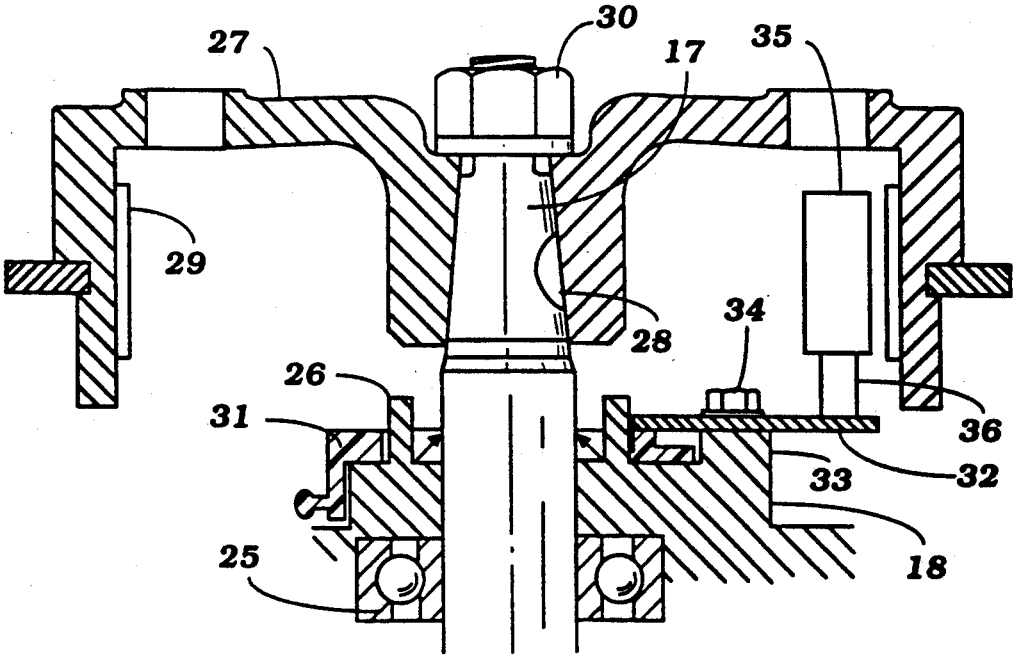
Figure 2 Prior Art
FIG. 2 is a cross sectional view showing a prior art type of mounting arrangement for the pulser and charging coils of the ignition system.
Figure 4:
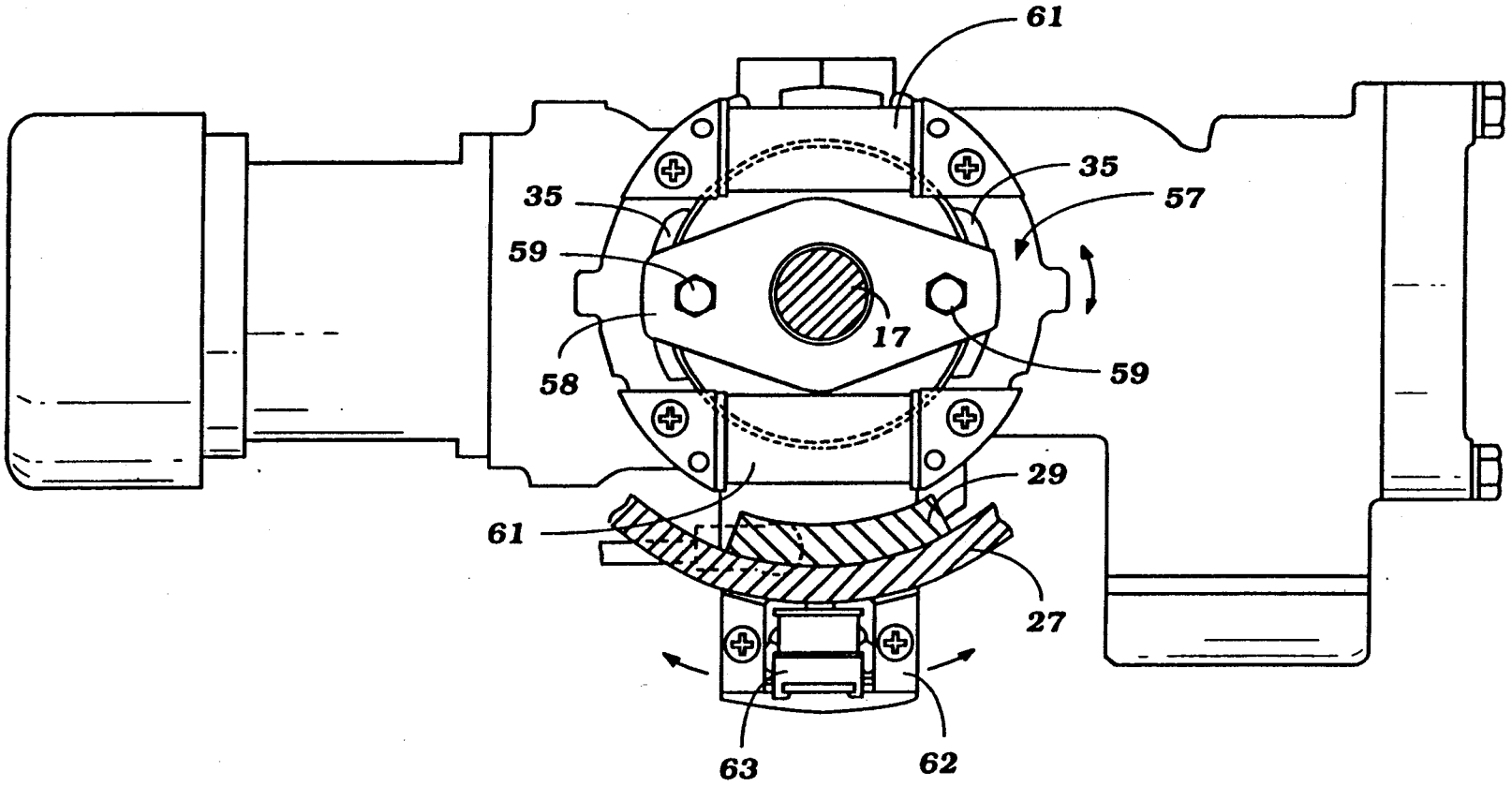
FIG. 4 is a top plan view of the flywheel end of the engine with the flywheel removed so as to more clearly show the mounting plate construction.

In FIGS. 3 and 4, certain components which are common to the prior art have been depicted and are identified by the same reference numerals. The engine crankcase 18 has a cylindrical boss 26 as with the prior art constructions. However, in conjunction with this embodiment, a nylon or other wear resistant bushing 56 is received over the outer surface of the boss 26 and rotatably journals an ignition timing plate, indicated generally by the reference numeral 57. The ignition timing plate 57 is held in position on this cylindrical outer surface by means of a retaining plate 58 which is affixed in place by a plurality of threaded fasteners 59 that are affixed directly to the boss 26 and inwardly of its outer bearing surface. Hence, the use of the separate boss of the prior art type of constructions is dispensed with.

Also, as may be readily apparent from FIG. 3, the mounting of the charging coils, indicated by the reference numeral 61 in FIG. 4 permits a lower mounting since clearance between the mounting bolts 59 is no longer a problem in accordance with this arrangement. As a result, the flywheel 27 may be lower from prior art type of constructions and a more compact engine assembly will result.

As may be seen in FIG. 4, the mounting plate 57 has an outwardly extending arm 62 on which the pulser coil 63 is mounted. Unlike prior art constructions, the pulser coil 63 is mounted on the outer periphery of the flywheel 27 rather than on its inner periphery.

It should be readily apparent that the described construction permits a very compact assembly and also a mounting arrangement for the pulser coil that permits a bearing type of mounting and hence, avoids the likelihood of timing variations when the outboard motor has its trim changed. Of course, the foregoing description is that of a preferred embodiment of the invention and various changes and modifications can be made without departing from the spirit and scope of the invention, as defined by the appended claims.

I claim:

1. An ignition arrangement for an internal combustion engine having an output shaft supported for rotation about an axis, an engine housing at least partially enclosing said output shaft, said engine housing having a generally cylindrical wall section extending from one face thereof, said output shaft having a portion extending through said one face of said engine housing and surrounded by said cylindrical wall, an ignition plate having a hub portion rotatably journaled on the outer surface of said cylindrical wall by an anti-friction bushing interposed between said hub portion of said ignition plate and the outer surface of the cylindrical wall, a retaining plate affixed to the end surface of said cylindrical wall inwardly of said outer surface for retaining said ignition plate to said engine, a flywheel affixed for rotation with said output shaft, and at least one ignition coil affixed to said ignition plate and cooperating with said flywheel.

2. An ignition arrangement as set forth in claim 1 wherein the flywheel has a flanged outer surface extending below the retaining plate.

3. An ignition arrangement as set forth in claim 1 wherein the retaining plate is affixed to the end surface of the cylindrical wall by a plurality of bolts.

4. An ignition arrangement as set forth in claim 3 wherein the flywheel has a flanged outer surface extending below the ignition plate.

5. An ignition arrangement as set forth in claim 4 further including a coil that is mounted on the ignition plate inside of the flange of the flywheel.

6. An ignition arrangement as set forth in claim 4 wherein the coil is mounted outside of the flange of the flywheel.

7. An ignition arrangement as set forth in claim 6 wherein there is a further ignition coil mounted on the ignition plate internally of the flywheel flange.

8. An ignition arrangement as set forth in claim 7 wherein the first mentioned coil is a pulser coil for an ignition circuit and the other coil comprises a charging coil for the ignition circuit.

9. An ignition arrangement for an internal combustion engine have an output shaft supported for rotation about an axis an engine housing at least partially enclosing said output shaft, said engine housing have a generally cylindrical wall section extending from one face thereof, said output shaft having a portion extending through said one face of said engine housing and surrounded by said cylindrical wall, an ignition plate having a hub portion rotatably journaled on the outer surface of said cylindrical wall, a retaining plate affixed to the end surface of said cylindrical wall inwardly of said outer surface for retaining said ignition plate to said engine, a flywheel affixed for rotation with said output shaft and having a depending flange, and at least one ignition coil affixed to said ignition plate and cooperating with the outer surface of said flange of said flywheel.

10. An ignition arrangement as set forth in claim 9 wherein the flywheel flange extends below the retaining plate.

11. An ignition arrangement as set forth in claim 10 further including an anti-friction bushing interposed between the hub portion of the ignition plate and the outer surface of the cylindrical wall.

12. An ignition arrangement as set forth in claim 10 wherein the retaining plate is affixed to the end surface of the cylindrical wall by a plurality of bolts.

13. An ignition arrangement as set forth in claim 9 further including a further coil that is mounted on the ignition plate inside of the flange of the flywheel.

14. An ignition arrangement as set forth in claim 9 wherein the coil mounted outside of the flange of the flywheel is a pulser coil for an ignition circuit.

15. An ignition arrangement as set forth in claim 14 wherein the coil mounted internally of the flywheel flange is a charging coil for the ignition plate circuit.

16. An ignition arrangement as set forth in claim 13 wherein the coils are mounted on the same side of the ignition plate relative to the cylindrical wall.

* * * * *

UNITED STATES PATENT AND TRADEMARK OFFICE

CERTIFICATE OF CORRECTION

PATENT NO. : 5,159,916

DATED : November 3, 1992

INVENTOR(S) : Atsushi Isogawa

It is certified that error appears in the above-identified patent and that said Letters Patent is hereby corrected as shown below:

Column 6, line 5, Claim 9, after "axis" insert --,--.

Column 6, line 38, Claim 15, delete "plate".

Signed and Sealed this

Ninth Day of November, 1993

*Attest:*

*Attesting Officer*

BRUCE LEHMAN

*Commissioner of Patents and Trademarks*